United States Patent [19]

Hopper

[11] Patent Number: 4,806,114

[45] Date of Patent: Feb. 21, 1989

[54] UNDERWATER ELECTRICALLY CONDUCTIVE COUPLING

[75] Inventor: Hans P. Hopper, Whiterashes, Scotland

[73] Assignee: The British Petroleum Company p.l.c., London, England

[21] Appl. No.: 905,650

[22] Filed: Sep. 11, 1986

[30] Foreign Application Priority Data

Sep. 14, 1985 [GB] United Kingdom ..... 8522772
Jul. 26, 1986 [GB] United Kingdom ..... 8618305

[51] Int. Cl.[4] ..... H01R 13/523
[52] U.S. Cl. ..... 439/191
[58] Field of Search ..... 439/196, 197, 191, 192, 439/193, 194, 195, 198, 199, 178, 179

[56] References Cited

U.S. PATENT DOCUMENTS

| | | | |
|---|---|---|---|
| 4,039,237 | 8/1977 | Cullen et al. | 439/191 |
| 4,117,287 | 9/1978 | Walker et al. | 439/191 |
| 4,142,770 | 3/1979 | Butler, Jr. et al. | 439/196 |
| 4,416,495 | 11/1983 | Regan . | |
| 4,494,602 | 1/1985 | Capdeboscqu et al. | 439/192 |
| 4,537,457 | 8/1985 | Davis, Jr. et al. | 439/191 |

FOREIGN PATENT DOCUMENTS 21134 9/1985 United Kingdom .

*Primary Examiner*—Eugene F. Desmond
*Attorney, Agent, or Firm*—Morgan & Finnegan

[57] ABSTRACT

An electrically conductive coupling, suitable for passing an electric current to or from an underwater well or underwater equipment comprises:

(a) an outer body having, on its inner surface, a recess,
(b) an inner body having, on its outer surface, a recess, the recesses being positioned so that they are aligned when the inner and outer bodies are mated to form an annular space,
(c) a resilient non-conductive member associated with the outer body having at least one inset conductive contact,
(d) a resilient non-conductive member associated with the inner body having at least one inset conductive contact, the two conductive members occupying the annular space and providing, through their inset conductive contacts an electrical path between the outer and inner bodies, and
(e) a passage for dielectric fluid to pass from the inner to the outer body or vice versa between the resilient non-conductive members and around or through the contact surfaces of the inset contacts.

7 Claims, 6 Drawing Sheets

UNDERWATER ELECTRICALLY CONDUCTIVE COUPLING

Figure 1:
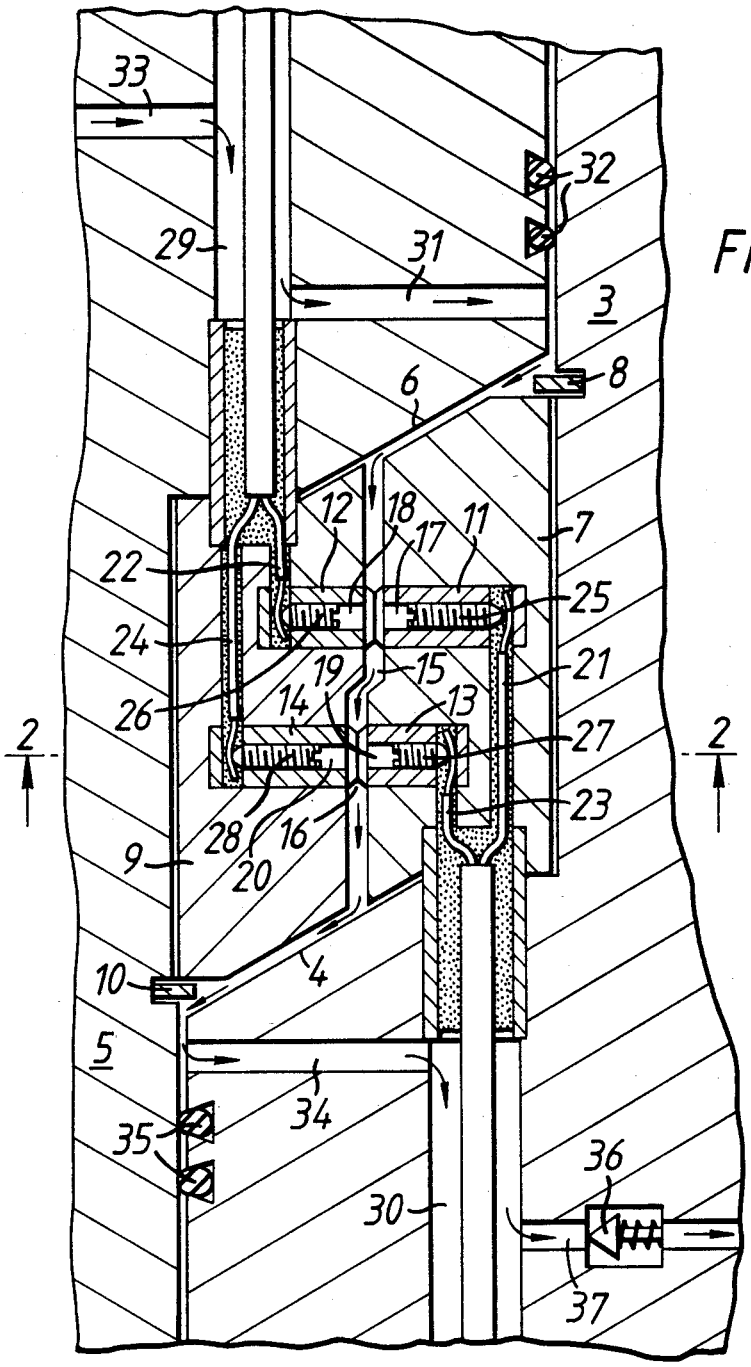

This invention relates to a conductive coupling for underwater use, suitable, for example, for passing an electric current to or from an underwater well or subsea equipment.

In the supply of electrical power to underwater wells or subsea equipment, or the receiving of electrical signals back from underwater wells and associated subsea equipment it is, obviously, of crucial importance to ensure that any connections are electrically isolated. A number of plug and socket connectors are already available for underwater electrical cables. A particular problem arises if it is desired to supply electrical power into a housing that is exposed to conductive fluids such as sea water or drilling mud. Thus, with certain electrical components or electrical monitoring equipment, the electrical contacts may be exposed to water or well fluids during installation and provision needs to be made so that these contacts can operate in a non-conductive environment and ensure a subsequently electrically isolated connection.

The present invention is concerned with an electrically conductive coupling which can be made up, and flushed to remove conductive fluids, the conductive fluid being then replaced by a suitable non-conductive fluid.

According to the present invention therefore an electrically conductive coupling, suitable for passing an electric current to or from an underwater well or underwater equipment comprises:

(a) an outer body having, on its inner surface, a recess, (b) an inner body having, on its outer surface, a recess, the recesses being positioned so that they are aligned when the inner and outer bodies are mated and form an annular space, (c) a resilient non-conductive member associated with the outer body having at least one inset conductive contact, (d) a resilient non-conductive member associated with the inner body having at least one inset conductive contact, the two conductive members occupying the annular space and providing, through their inset conductive contacts an electrical path between the outer and inner bodies, and (e) a passage for dielectric fluid to pass from the inner to the outer body or vice versa between the resilient non-conductive members and around or through the contact surfaces of the inset contacts.

In one embodiment, the conductive coupling may be used to pass an electric current into or from a well head itself, the coupling then comprising (a) an outer housing having a shoulder on its inner surface, (b) an inner housing having a shoulder on its outer surface, the two shoulders being at different vertical heights to form an annular space between the outer and inner bodies, (c) a resilient non-conductive member associated with the outer body having at least one inset conductive contact, (d) a second resilient non-conductive member associated with the inner body also having at least one inset conductive contact, the two non-conductive members occupying the annular space between the outer and inner bodies, and providing through their inset conductive contacts an electrical path between the outer and inner bodies, and (e) a passage for dielectric fluid to pass from the inner to the outer body or vice versa between the non-conductive members and around or through the contact surfaces of the inset contacts.

The outer housing may be a tubing hanger housing and the inner housing may be a tubing hanger running tool or an inner tree component (e.g. a tree stinger).

The shoulders on the outer and inner bodies may be sloped so that the annular space between the bodies is, in cross section, a parallelogram.

The resilient non-conductive members may be held onto their respective outer and inner bodies by retaining rings.

In another embodiment, the conductive coupling may be used to pass an electric current through a stab connection between any two parts of an underwater assembly e.g. between a control pod and a tree module or manifold module or between two parts of an orientated connector. In this embodiment, the coupling comprises:

(a) a stab having, on its outer surface, an annular recess, (b) a spring loaded sheath covering the recess when the stab is not mated, (c) a stab receptacle having, on its inner surface, an annular recess, (d) a spring loaded plug covering the recess when the receptacle is not mated, (e) a resilient non-conductive member in each recess having at least one inset conductive contact, (f) means for moving the spring loaded sheath and spring loaded plug when the stab and receptacle are mated so that the resilient non-conductive members are aligned with their contacts touching thus providing an electrical path between the stab and the receptacle, and (g) a passage for dielectric fluid to pass from the stab to the receptacle or vice versa between the resilient non-conductive members and around or through the contact surfaces of the inset contacts.

The stab may be splined into a housing which may be loosely aligned with a floating base plate. The receptable may also be loosely aligned with a structural base plate, thereby giving a degree of movement for the stab and receptacle to assist in mating and aligning the contacts.

The resilient non-conductive members of all embodiments of the present invention may be made of a suitable flexible non-conductive material e.g. rubber and may be of a size in relation to the annular space into which they fit so that they are slightly compressed when they are in place and the surfaces of the inset conductive contacts are touching.

The inset conductive contacts of at least one of the resilient non-conductive members stand slightly proud of its member so that there is a gap between the members, this gap being part of the passage for dielectric fluid. In the embodiment with a stab and receptacle, the inset conductive contacts of the receptable may be flush with the resilient non-conductive member to form a smooth, slick surface for mating and the inset conductive contacts of the stab may stand proud of their resilient non-conductive member.

The inset contacts may be in the form of a ring extending around the circumferences of the non-conductive members. If they are rings there is no need for any orientation between the outer and inner bodies and this is to be preferred with couplings between a tubing hanger body and an inner tree body or running tool. To allow dielectric fluid to pass around or through the contact surfaces of the inset contacts, however, the parts of the contact rings which stand proud of the members should have notches around their periphery.

Alternatively, the inset contacts may be a series of studs set into the resilient non-conductive members. If they are studs then there will be a path for the dielectric fluid to flow around them. However, the outer and inner bodies will need to be orientated so that the studs match up when the parts are mated. The bodies should therefore have suitable pins and slots or other orientating devices.

Preferably there are at least two contact rings or sets of contact studs in each resilient non-conductive member. If a three phase electric current is used, there may be three rings or sets of stud, one for each phase.

The inset contacts of the members may have wires connected to them via vertical passages in the outer and inner bodies. Further horizontal cross passages may run from these vertical passages to the boundary between the outer and inner bodies above and below the recesses. These vertical and horizontal passages form part of the overall passage for dielectric fluid.

Elastomeric seals may be placed above or below the conductive coupling and the cross passages, to seal the outer and inner bodies and ensure that the flow of dielectric fluid is contained within and directed through the conductive coupling.

The outer and inner bodies are preferably circular.

The conductive coupling of the present invention is particularly suitable for use with concentric well completions, allowing electrical equipment to be placed in the well. The electrical leads from the coupling may be passed into the annulus through a pressure seal coupling and a similar coupling may be used at the exit from the inner tree or running tool.

Figure 2:
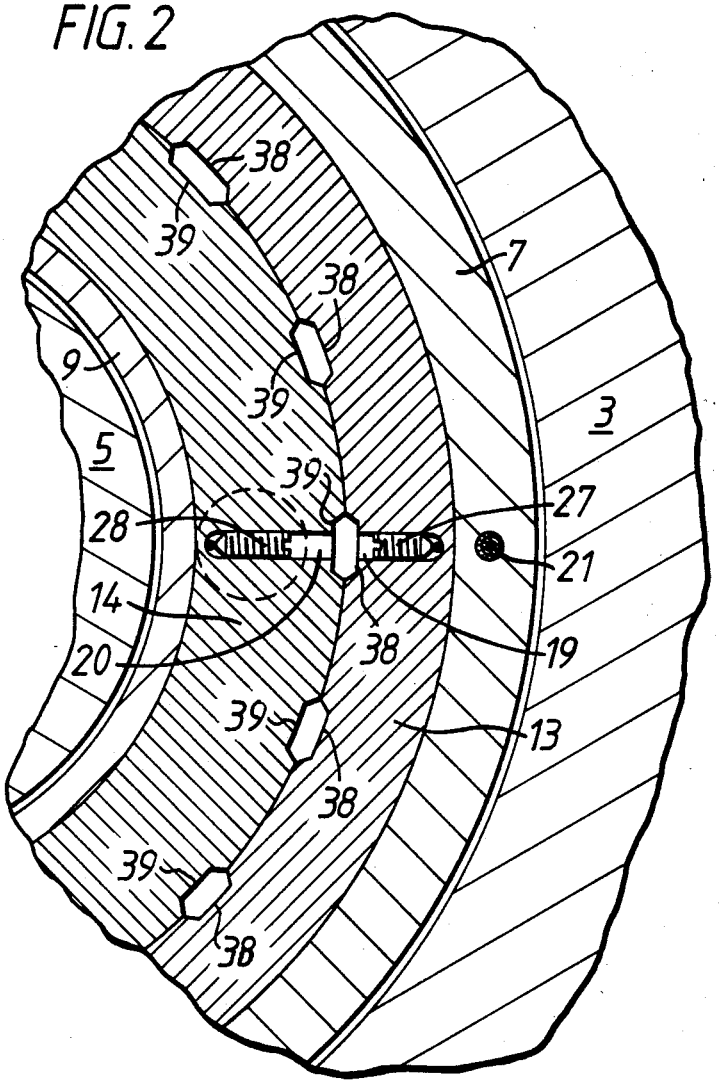
Figure 3:
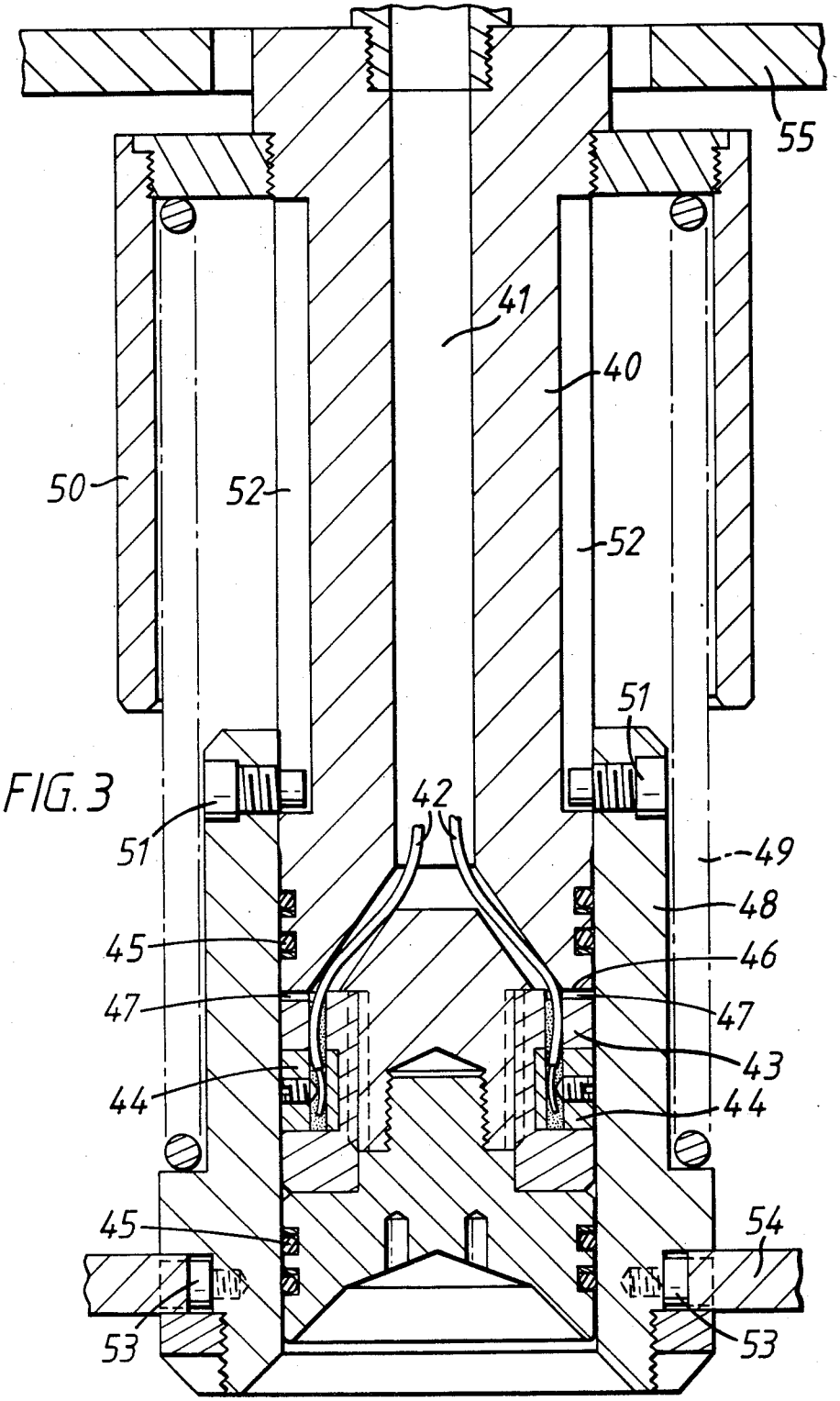
Figure 4:
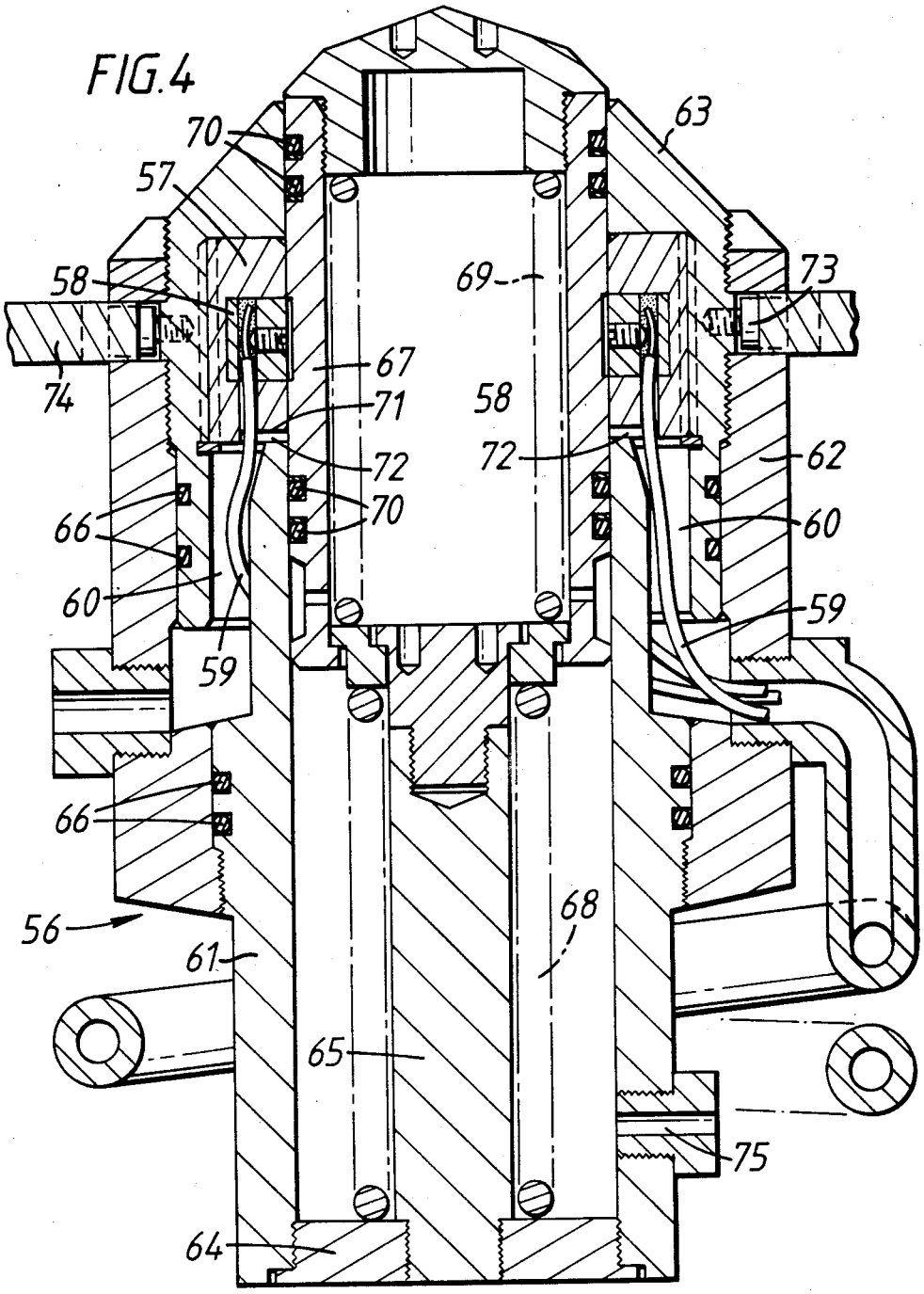
Figure 5:
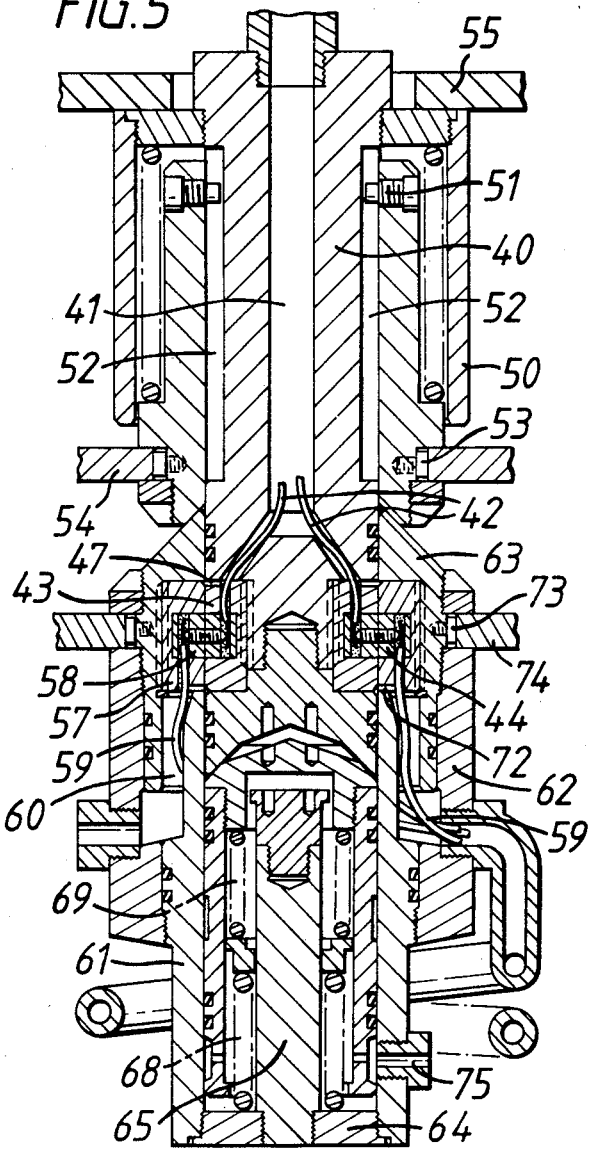
Figure 6:
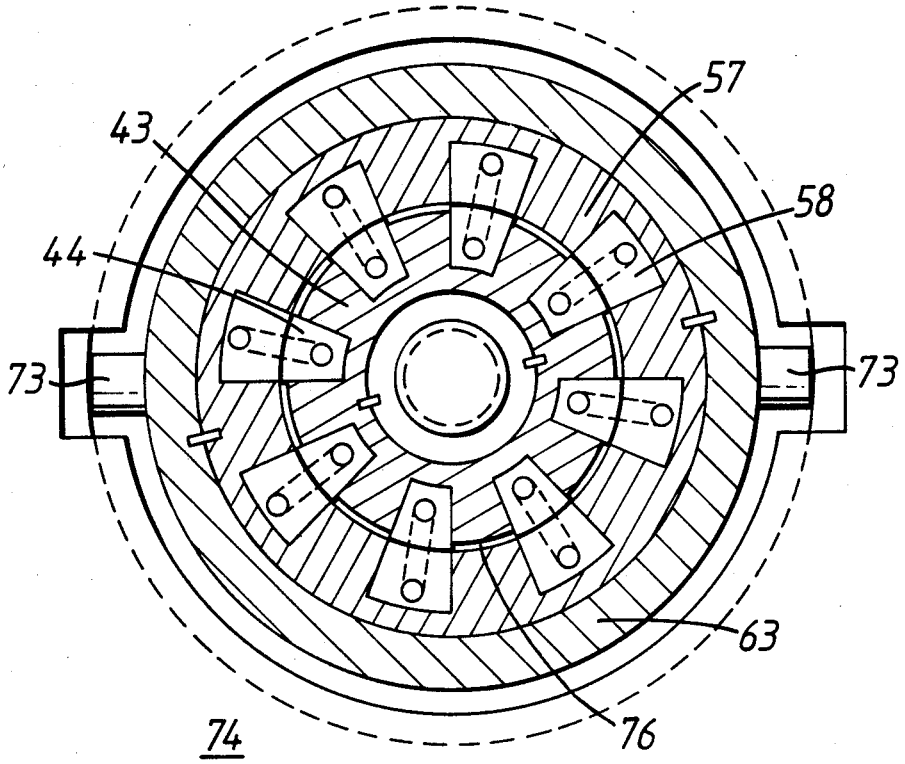

The invention is particularly described with reference to the accompanying drawings in which FIG. 1 is a cross-section through a conductive coupling according to the present invention, and FIG. 2 is a section along line 2—2 of FIG. 1. FIG. 3 is a vertical section through a stab component of an electrical conductive coupling, FIG. 4 is a vertical-section through a receptacle component of an electrical conductive coupling, FIG. 5 is a vertical-section through the mated stab and receptacle components of FIGS. 3 and 4, and FIG. 6 is a horizontal section through the mated stab and receptacle components of FIGS. 3 and 4.

In FIG. 1 a circular tubing hanger body 3 of an underwater well has a sloping shoulder 4. Within body 3 is an inner body 5 also having a sloping shoulder 6. This inner body may be a tubing hanger running tool used during the completion of a well or a tree connector in a completed well.

The shoulders 4 and 6 are not landed face to face, thereby forming an annular space between bodies 3 and 5. Within this space is a non-conductive contact ring support member 7 associated with outer body 3 and held to it by retaining ring 8. The edge of member 7 is chamfered to accommodate the retaining ring 8. Also within the space is another non-conductive contact ring support member 9 associated with inner body 5 and held to it by retaining ring 10. The edge of member 9 is also chamfered to accommodate the retaining ring 10. Members 7 and 9 are resilient and compressable and also non-conductive. They are manufactured to a friction fit with respect to the annular space so that, when in place, they are compressed radially. Inserted into each of non-conductive members 7 and 9 are two electrically conductive contact rings (11, 12 and 13, 14). These conductive rings stand proud of the members leaving a gap 15 between them. Where the conductive rings stand proud notches 16 are cut into them so that fluid can pass through the gap 15. The disposition of the notches is shown in detail in FIG. 2 and discussed in more detail hereafter.

Each contact ring has a screw threaded hole (17,18,19,20) allowing wires (21,22,23,24) to be connected to them by screws (25,26,27,28). Wires 22 and 24 pass up from member 9 into a vertical passage 29 drilled into inner body 5 and eventually into a pressure seal electrical coupling (not shown) in the tree running tool or tree block. Wires 21,23 pass down from member 7 into a passage 30 drilled into outer body 3 and eventually into a pressure seal electrical coupling (not shown) in the well annulus.

From passage 29 a horizontal passage 31 extends to the boundary of the outer and inner bodies 3 and 5 below elastomeric seals 32 which make a fluid tight joint between the bodies.

The passage system of the inner body 5 is completed by a further horizontal passage 33 in the inner body 5 from vertical passage 29 which is ported back through inner body 5 to a point where dielectric fluid can be pumped in. Passage 33 communicates with the dielectric vertical control bore and vertical passage 29 extends up into the tree block and through seals to wherever the cable is required to go. Horizontal passage 34 in the outer body 3 extends from the boundary of the outer and inner bodies above elastomeric seals 35 and communicates with vertical passage 30. The passage system in the outer body 3 is completed by a further horizontal passage 37 having a check valve 36 in it. It communicates with a vent line (not shown), which is a return porting within the confines of the wellhead.

In FIG. 2, which is a section through line 2—2 of FIG. 1, vertical notches 38 are shown running down the contact surface of ring 13 and notches 39 running down the contact surface of ring 14. There will be similar notches on the contact surfaces of rings 11 and 12.

In the drawing the sets of notches on each of the rings are shown as aligned, and this can be achieved by the use of a suitable orientation system. However, it will be seen that even if the notches are not aligned, passages will exist to allow dielectric fluid to pass through between the contact surfaces of the rings.

The coupling may be assembled by passing the electrical cable through passages 29 and 30 and through the passages in the resilient non-conductive members, and attaching the cable ends to the contact rings with screws 25,26,27,28. The cables are then sealed into the non-conductive members with a suitable non-conductive filler. The non-conductive members are brought to their positions in the shoulders on the outer and inner bodies (any slack in the electrical cables being taken up) and the retaining rings 8 and 10 inserted. The ends of passages 29 and 30 adjacent the non-conductive members may also be sealed with non-conductive filler but this sealing should not extend up to horizontal passage 31 or down to horizontal passage 34. The set of elastomeric seals is then installed.

The tubing hanger body may then be mated with the inner running tool on the deck of a work vessel or semisubmersible drilling rig. Dielectric fluid is then pumped through the coupling along passages 33,29 and 31. It then flows between the outer and inner bodies, past retaining ring 8, between inner body 5 and outer non-conductive member 7 and so between non-conductive members 7 and 9 and through the notches in contact rings 11,12,13 and 14. It then passes between outer body 3 and inner non-conductive member 9 between the outer and inner bodies and out through passage 34. (The flow path is indicated by arrows in FIG. 1). The flow of dielectric fluid is continued until a reasonable flow of dielectric fluid is observed at the vent and the system checked for electrical continuity. For observing the flow, the vent line may be returned through porting and a control line to a flow monitoring position.

The tubing hanger body and running tool may then be run and the tubing hanger body installed in the well head. The tool is retrieved. A well tree inner body is then made up and this is run and landed. During this operation the conductive coupling will be exposed to water.

The completed coupling may, however, be flushed out, first with a fresh water wash through the passages, then with an oil wetting surfactant and finally with dielectric fluid as described above for the tubing hanger and running tool.

Most conventional dielectric fluids have positive buoyancy with respect to water (i.e. they have a specific gravity of less than 1). The flow of dielectric fluid in FIGS. 1 and 2 has thus been shown generally downwards, with entrapped water or other fluids being forced downwards and out by the flushing action of the dielectric fluid assisted by gravity.

It is possible, however, to produce dielectric fluids having negative buoyancy with respect to water. If such a dielectric fluid were to be used, the design would be inverted and the flow would be in the reverse upward direction with the water or other fluid being expelled at the top.

FIGS. 3 to 6 also assume the use of a positive buoyancy dielectric fluid with downward flow of the fluid.

FIGS. 3 to 6 show a stab type conductive coupling according to the present invention. Although the drawings show the stab and receptacle in a vertical position the coupling can operate in any position from the vertical to the horizontal provided that the outlet of the receptacle 77 is at the lowest point.

In FIG. 3 the stab 40 has a central passage 41 for electrical cables 42 and for dielectric fluid flushing. A resilient non-conductive member 43 fits into a recess in the stab. Member 43 holds a series of conductive contact studs 44 which are segmentally shaped (see FIG. 6). Pairs of ring seals 45 are positioned around the circumference of the stab above and below the resilient non-conductive member 43, which has a step 46 in its upper surface to provide a passage 47 from passage 41 to the outer circumference of member 43.

Surrounding the lower part of stab 40 and covering non-conductive member 43 is a sheath 48. This is spring loaded by spring 49 which extends into spring housing 50 attached to the upper part of the stab 4. Orientation pins 51 in the sheath cooperate with orientation slots 52 in the stab. The sheath has further orientation pins at 53 and a floating base plate 54, the pins 53 orientating the sheath with respect to the base plate. The stab may be part of any suitable piece of underwater equipment, which is indicated diagrammatically by structural plate 55. Floating base plate 54 may be correctly orientated on the underwater equipment with respect to the structural plate 55 by guide pins or keys which align with the structural plate 55.

In FIG. 4 a receptacle 56 for the stab of FIG. 3 is a cylindrical body having on its inner surface a resilient non-conductive member 57 with inset segmented stud contacts 58. Electrical cables 59 are connected to these contacts, passing down through annular passage 60 between inner and outer portions 61,62 of the receptacle. The receptable is completed by a truncated cone 63 at its top, plate 64 at its base and a stem 65 extending up from plate 64. Suitable ring seals 66 are placed between the component portions of the receptable. Receptacle 56 also has a line 75 through which any liquid within the receptacle below plug 67 can be vented to a balance chamber when the plug is moved during mating.

Within receptacle 56 is moveable hollow plug 67 which slides on stem 65 and is spring loaded by spring 68 surrounding the stem. Within hollow plug 67 is a further spring 69 which has the same compressive force as spring 68.

Ring seals 70 in the plug 67 are positioned above and below the resilient non-conductive member 57. Member 57 has, in the same way as member 43 of the stab (FIG. 3), a step 71 on its lower surface providing a passage 72 from passage 60 to the inner circumference of member 57.

Receptacle 56 may be part of any suitable piece of underwater equipment. Receptacle 56 has orientation pins 73 and a structural base plate 74, pins 73 orientating the receptacle with respect to the base plate. This base plate 74 may be orientated to line up with base plate 54 (FIG. 3) of the stab portion of the connector.

FIG. 5 shows the mated stab and receptacles of FIGS. 3 and 4 with the parts indicated by the same numerals as in FIGS. 3 and 4. It will be seen that, during mating, stab 40 pushes against plug 67 forcing it down around stem 65 against the force of springs 68 and 69. At the same time receptacle 56 pushes stab 40 until it contacts structural plate 55 and then pushes sheath 48 up into housing 50 against the force of spring 49. The resilient non-conductive members 43 and 57 become aligned and the studs 44 and 58 are brought into contact. This is shown particularly in FIG. 6 which is a section through the mated parts at the level of the aligned members 44 and 58. It will be seen from FIG. 6 that the stud contacts 58 in the non-conductive member 57 of the receptacle are flush with the surface of member 57 giving a smooth, slick surface to assist mating. Stud contacts 44 in the non-conductive member 43 of the stab stand proud of the surface of member 43, thereby creating an annular gap 76 between the surfaces of members 57 and 43.

It will also be seen from FIGS. 5 and 6 that a pathway exists for dielectric fluid from passage 41 in stab 40, along passage 47, down through annular gap 76 between members 43 and 57 and around studs 44 and 58, along passage 72 and then through passage 60 to vent 77. This embodiment of the invention can, thus, be flushed with dielectric fluid in a manner similar to that of the embodiment of FIGS. 1 and 2.

The passages in the stab and receptacle may be filled with dielectric fluid prior to mating as may the void space in the receptacle below the plug. However this should not be relied on to prevent ingress of conductive fluids during mating and flushing through with further dielectric fluid after mating is considered necessary.

Dielectric fluid in the void space of the receptacle below the plug will be forced out through line 75 during mating to a balance chamber, from whence it can return if the stab is withdrawn.

Any suitable dielectric fluid may be used with, as indicated earlier, either positive or negative buoyancy. Positive buoyancy fluids are preferred, e.g. an electrical insulating oil or a silicone based oil.

Alignment of the stab and receptacle so that they mate and are also correctly orientated so that the studs 43 and 58 are aligned can be achieved by suitable guidance means associated with the base plate 54 of the stab component and base plate 74 of the receptacle component.

Thus base plate 54 can float on, e.g. spring guide pins associated with mechanical latches of a pod or self-aligning soft landing jacks of a connector. The base plate 74 is fixed onto a lower body with suitable orientation and guidance means for the latches, soft landing jacks or other corresponding parts of the stab component.

The particular advantages and benefits of the conductive coupling of the present invention are:

(i) it can be made up in one action as the equipment is mated and then flushed with dielectric fluid to achieve a working electrical coupling, (ii) it can be made up in a conductive environment and any conductive medium can subsequently be expelled, (iii) it operates with dielectric fluid surrounding the contacts. Further this dielectric fluid can be flushed out and replaced with fresh fluid at any time during the life of the coupling without having to separate the parts of the coupling.

I claim:

1. An electrically conductive coupling, suitable for passing an electric current to or from an underwater well or underwater equipment comprising:

(a) an outer body having, on its inner surface, a recess, (b) an inner body having, on its outer surface, a recess, the recesses being positioned so that they are aligned when the inner and outer bodies are mated to form an annular space, (c) a resilient non-conductive member associated with the outer body having at least one inset conductive contact, (d) a resilient non-conductive member associated with the inner body having at least one inset conductive contact, the two conductive members occupying the annular space and providing, through their inset conductive contacts an electrical path between the outer and inner bodies, and (e) a passage for dielectric fluid to pass from one body to the other between the resilient non-conductive members and around the contact surfaces of the inset contacts.

2. An electrically conductive coupling as claimed in claim 1 suitable for passing an electrical current to or from a well head, comprising:

(a) an outer body which is a tubing hanger housing having a shoulder on its inner surface, (b) an inner body which is selected from a tubing hanger running tool and an inner tree component having a shoulder on its outer surface, the two shoulders being at different vertical heights to form an annular space between the outer and inner bodies, (c) a resilient non-conductive member associated with the outer body having at least one inset conductive contact, (d) a second resilient non-conductive member associated with the inner body also having at least one inset conductive contact, the two non-conductive members occupying the annular space between the outer and inner bodies, and providing through their inset conductive contacts an electrical path between the outer and inner bodies, and (e) a passage for dielectrical fluid to pass from one body to the other, between the non-conductive members and around the contact surfaces of the inset contacts.

3. An electrically conductive coupling as claimed in claim 1 suitable for passing an electrical current through a stab connection, formed of an inner male body adapted to mate with an outer female body comprising (a) an inner stab body having, on its outer surface, an annular recess, (b) a spring loaded sheath covering the recess when the stab is not mated, (c) an outer stab receptacle body having on its inner surface, an annular recess, (d) a spring loaded plug covering the recess when the receptacle is not mated, (e) a resilient non-conductive member in each recess having at least one inset conductive contact, (f) means for moving the spring loaded sheath and spring loaded plug when the stab and receptacle are mated so that the resilient non-conductive members are aligned with their contacts touching thus providing an electrical path between the stab and the receptacle and (g) a passage for dielectric fluid to pass from one body to the other between the resilient non-conductive members and around the contact surfaces of the inset contacts.

4. An electrically conductive coupling as claimed in claim 1 wherein the passage for dielectric fluid has an outlet below the level of an inlet therefor.

5. An electrically conductive coupling as claimed in claim 1, 2 or 3 wherein the inset contacts are rings.

6. An electrically conductive coupling as claimed in claim 1, 2, or 3 wherein the contacting surfaces of the contact rings are notched.

7. An electrically conductive coupling as claimed in claim 1, 2 or 3 wherein the inset contacts are studs.

* * * * *